US009402441B2

(12) United States Patent
Christensen et al.

(10) Patent No.: US 9,402,441 B2
(45) Date of Patent: Aug. 2, 2016

(54) SOLE AND ARTICLE OF FOOTWEAR

(71) Applicant: Reebok International Limited, London (GB)

(72) Inventors: Brian Christensen, Centerville, MA (US); Matthew J. Montross, Middleboro, MA (US); Alexandre Leblanc, Boston, MA (US); Paul E. Litchfield, Westboro, MA (US); William Marvin, Canton, MA (US); Frank Millette, Middleboro, MA (US)

(73) Assignee: Reebok International Limited, London (GB)

( * ) Notice: Subject to any disclaimer, the term of this patent is extended or adjusted under 35 U.S.C. 154(b) by 0 days.

(21) Appl. No.: 14/505,163

(22) Filed: Oct. 2, 2014

(65) Prior Publication Data

US 2015/0052782 A1 Feb. 26, 2015

Related U.S. Application Data

(63) Continuation of application No. 14/203,133, filed on Mar. 10, 2014, now abandoned, which is a continuation of application No. 12/980,961, filed on Dec. 29, 2010, now Pat. No. 8,707,587.

(51) Int. Cl.
*A43B 13/18* (2006.01)
*A43B 3/00* (2006.01)
(Continued)

(52) U.S. Cl.
CPC ..... *A43B 13/181* (2013.01); *A43B 3/0057* (2013.01); *A43B 5/06* (2013.01);
(Continued)

(58) Field of Classification Search
CPC ..... A43B 13/14; A43B 13/141; A43B 13/16; A43B 13/186; A43B 13/188; A43B 13/181; A43B 13/22; A43B 13/223; A43B 13/26; A43B 13/24
USPC ..... 36/103, 28, 31
See application file for complete search history.

(56) References Cited

U.S. PATENT DOCUMENTS 1,607,375 A 11/1926 Whipple
D149,139 S 3/1948 Parker
(Continued)

FOREIGN PATENT DOCUMENTS

JP 11000203 1/1999
JP 11235202 8/1999
(Continued)

OTHER PUBLICATIONS

K-Swiss, Inc. Online Store—Tubes Run 100A, http://www.kswiss.com/item/201.200/02316-162/Men/Footwear_Running/Tubes_Run_100_A/Wht_Blk_Sunorng.html (visited Oct. 2, 2009), 2 pages.
(Continued)

*Primary Examiner* — Ted Kavanaugh
(74) *Attorney, Agent, or Firm* — Sterne, Kessler, Goldstein & Fox P.L.L.C.

(57) ABSTRACT

Articles of footwear and soles are disclosed. The article of footwear may include an upper; an outer midsole having a base coupled to the upper, and a rim portion extending from the periphery of the base, wherein the rim portion defines a plurality of spaced apart gaps; and an inner midsole disposed interiorly to the rim portion, wherein a portion of the inner midsole is disposed in at least one gap.

22 Claims, 11 Drawing Sheets

(51) Int. Cl.

| | |
|---|---|
| ***A43B 13/14*** | (2006.01) |
| ***A43B 5/06*** | (2006.01) |
| ***A43B 7/32*** | (2006.01) |
| *A43B 13/24* | (2006.01) |

(52) U.S. Cl.

CPC ..... *A43B 7/32* (2013.01); *A43B 13/14* (2013.01); *A43B 13/186* (2013.01); *A43B 13/188* (2013.01); *A43B 13/24* (2013.01)

(56) References Cited

U.S. PATENT DOCUMENTS

| | | | | |
|---|---|---|---|---|
| D157,034 | S | | 1/1950 | Eldon |
| D173,030 | S | | 9/1954 | Hoza |
| 2,722,756 | A | | 11/1955 | Ecclesine |
| 3,444,632 | A | | 5/1969 | Hack et al. |
| 3,834,046 | A | | 9/1974 | Fowler |
| D233,805 | S | | 12/1974 | Kubo |
| 4,130,947 | A | | 12/1978 | Oenu |
| 4,561,195 | A | | 12/1985 | Onoda et al. |
| 4,642,917 | A | | 2/1987 | Ungar |
| 4,798,010 | A | | 1/1989 | Sugiyama |
| 4,805,319 | A | | 2/1989 | Tonkel |
| 4,864,737 | A | | 9/1989 | Marrello |
| 5,077,916 | A | * | 1/1992 | Beneteau ..... 361/114 |
| D326,014 | S | | 5/1992 | Issler |
| D334,282 | S | | 3/1993 | Greene |
| D347,516 | S | | 6/1994 | Foster |
| 5,319,866 | A | | 6/1994 | Foley et al. |
| 5,367,791 | A | * | 11/1994 | Gross et al. ..... 36/31 |
| D360,065 | S | | 7/1995 | Werman |
| D364,497 | S | | 11/1995 | Schelling |
| 5,469,639 | A | | 11/1995 | Sessa |
| D367,952 | S | | 3/1996 | Shea |
| D378,011 | S | | 2/1997 | Lucas |
| D379,259 | S | | 5/1997 | Kayano |
| D385,987 | S | | 11/1997 | Bramani |
| D390,346 | S | | 2/1998 | Loveder |
| 5,713,140 | A | | 2/1998 | Baggenstoss |
| D394,945 | S | | 6/1998 | Doxey |
| D395,739 | S | | 7/1998 | Mervar |
| 5,775,005 | A | * | 7/1998 | McClelland ..... 36/31 |
| D396,947 | S | | 8/1998 | Serna |
| D397,847 | S | | 9/1998 | Hudson |
| 5,799,415 | A | | 9/1998 | Kenji et al. |
| 5,815,949 | A | * | 10/1998 | Sessa ..... 36/3 B |
| D402,455 | S | | 12/1998 | Greenberg |
| 5,987,782 | A | | 11/1999 | Bramani |
| D420,497 | S | | 2/2000 | Panella |
| D421,834 | S | | 3/2000 | Cooper |
| D424,287 | S | | 5/2000 | Edwards |
| 6,079,125 | A | | 6/2000 | Quellais et al. |
| 6,108,943 | A | | 8/2000 | Hudson et al. |
| 6,138,385 | A | | 10/2000 | Jungkind et al. |
| 6,205,681 | B1 | | 3/2001 | Kita |
| 6,219,939 | B1 | | 4/2001 | Kita et al. |
| 6,219,940 | B1 | | 4/2001 | Kita |
| 6,226,896 | B1 | | 5/2001 | Friton |
| 6,289,608 | B1 | | 9/2001 | Kita et al. |
| D449,433 | S | | 10/2001 | Matis et al. |
| 6,295,741 | B1 | | 10/2001 | Kita |
| 6,311,414 | B1 | | 11/2001 | Kita |
| 6,314,664 | B1 | | 11/2001 | Kita et al. |
| 6,338,206 | B1 | | 1/2002 | Kita |
| 6,389,713 | B1 | | 5/2002 | Kita |
| 6,393,732 | B1 | | 5/2002 | Kita |
| 6,401,365 | B2 | | 6/2002 | Kita et al. |
| 6,438,870 | B2 | | 8/2002 | Nasako et al. |
| 6,516,539 | B2 | | 2/2003 | Nishiwaki et al. |
| 6,557,270 | B2 | | 5/2003 | Nakano et al. |
| 6,606,804 | B2 | | 8/2003 | Kaneko et al. |
| 6,625,905 | B2 | | 9/2003 | Kita |
| 6,647,645 | B2 | | 11/2003 | Kita |
| 6,675,500 | B1 | | 1/2004 | Cadamuro |
| 6,711,834 | B1 | | 3/2004 | Kita |
| D489,881 | S | | 5/2004 | Recchi |
| 6,754,981 | B1 | | 6/2004 | Edwards |
| 6,810,605 | B2 | | 11/2004 | Nakano et al. |
| 6,964,119 | B2 | | 11/2005 | Weaver, III |
| D516,293 | S | | 3/2006 | Smith, III |
| D523,232 | S | | 6/2006 | Shaffer |
| D523,614 | S | | 6/2006 | Mitchell |
| D523,628 | S | | 6/2006 | Young |
| 7,055,198 | B2 | | 6/2006 | Cadamuro et al. |
| D524,034 | S | | 7/2006 | Hlavacs |
| D524,035 | S | | 7/2006 | Greene et al. |
| D524,535 | S | | 7/2006 | Cass |
| 7,089,152 | B2 | | 8/2006 | Oda et al. |
| D528,778 | S | | 9/2006 | Avar et al. |
| D529,267 | S | | 10/2006 | Portzline |
| D530,905 | S | | 10/2006 | Jonsson |
| 7,162,815 | B2 | | 1/2007 | Miyauchi et al. |
| D537,611 | S | | 3/2007 | Matis et al. |
| D546,532 | S | | 7/2007 | Matis et al. |
| D561,985 | S | | 2/2008 | Andersen et al. |
| 7,337,559 | B2 | | 3/2008 | Russell |
| D569,594 | S | | 5/2008 | Horne et al. |
| D569,595 | S | | 5/2008 | Le |
| D570,078 | S | | 6/2008 | Davis |
| D574,581 | S | | 8/2008 | Cooper |
| D574,583 | S | | 8/2008 | St-Louis et al. |
| D574,602 | S | | 8/2008 | Grenet |
| D574,604 | S | | 8/2008 | McMillan |
| 7,444,767 | B2 | * | 11/2008 | Kilgore et al. ..... 36/30 R |
| D586,991 | S | | 2/2009 | Fuerst |
| D592,383 | S | | 5/2009 | Wawrousek |
| D592,847 | S | | 5/2009 | Rosenbaum |
| D594,195 | S | | 6/2009 | Nakano |
| 7,549,236 | B2 | | 6/2009 | Dillon et al. |
| D596,386 | S | | 7/2009 | Brambilla |
| 7,556,846 | B2 | | 7/2009 | Dojan et al. |
| D599,986 | S | | 9/2009 | Reiss |
| D600,895 | S | | 9/2009 | Morgan |
| D601,334 | S | | 10/2009 | Werman |
| D605,838 | S | | 12/2009 | Foust |
| D607,193 | S | | 1/2010 | Recchi |
| D607,633 | S | | 1/2010 | Mongelli |
| D609,441 | S | | 2/2010 | Wawrousek |
| D615,741 | S | | 5/2010 | Matis et al. |
| D617,085 | S | | 6/2010 | Recchi et al. |
| 7,762,008 | B1 | | 7/2010 | Clark et al. |
| D622,043 | S | | 8/2010 | Hauglin |
| D624,293 | S | | 9/2010 | Recchi et al. |
| D634,922 | S | | 3/2011 | Pauk et al. |
| D636,567 | S | | 4/2011 | Raysse |
| 7,918,041 | B2 | * | 4/2011 | Cho ..... 36/3 B |
| 7,946,058 | B2 | | 5/2011 | Johnson et al. |
| D642,776 | S | | 8/2011 | Raysse |
| D643,194 | S | | 8/2011 | Raysse |
| D644,420 | S | | 9/2011 | Christopherson |
| D644,824 | S | | 9/2011 | Leleu |
| D646,871 | S | | 10/2011 | Christopherson |
| D649,753 | S | | 12/2011 | Callahan et al. |
| D649,754 | S | | 12/2011 | Callahan et al. |
| D652,201 | S | | 1/2012 | Vestuti et al. |
| D659,958 | S | | 5/2012 | Birkinhead |
| D659,959 | S | | 5/2012 | Vestuti et al. |
| D659,964 | S | | 5/2012 | Callahan et al. |
| D659,965 | S | | 5/2012 | Callahan et al. |
| D668,028 | S | | 10/2012 | Pope |
| 2001/0008053 | A1 | | 7/2001 | Belli |
| 2003/0101621 | A1 | | 6/2003 | Nishiwaki et al. |
| 2004/0154189 | A1 | * | 8/2004 | Wang ..... 36/28 |
| 2006/0137227 | A1 | | 6/2006 | Kita et al. |
| 2006/0283045 | A1 | | 12/2006 | Kita et al. |
| 2007/0209230 | A1 | | 9/2007 | Dillon et al. |
| 2008/0052965 | A1 | | 3/2008 | Sato |
| 2008/0066347 | A1 | | 3/2008 | Suzuki |
| 2008/0229617 | A1 | | 9/2008 | Johnson et al. |
| 2010/0175280 | A1 | | 7/2010 | Rinehart et al. |
| 2010/0192420 | A1 | | 8/2010 | Favraud |
| 2010/0325917 | A1 | | 12/2010 | Cass et al. |
| 2011/0016746 | A1 | | 1/2011 | Callahan et al. |

(56) References Cited

U.S. PATENT DOCUMENTS

| | | | |
|---|---|---|---|
| 2011/0016749 | A1 | 1/2011 | Callahan et al. |
| 2011/0289799 | A1 | 12/2011 | Keating et al. |
| 2012/0000095 | A1 | 1/2012 | Torrance |

FOREIGN PATENT DOCUMENTS

| | | |
|---|---|---|
| JP | 2001275711 | 10/2001 |
| JP | 2002336003 | 11/2002 |
| JP | 2003339405 | 12/2003 |
| JP | 2004173884 | 6/2004 |
| JP | 2004267516 | 9/2004 |
| JP | 2005253578 | 9/2005 |

OTHER PUBLICATIONS

Adidas Q2 2007 Footwear Catalog, p. 5, showing the T 7 ATS shoe, and p. 122, showing the J S3 W shoe.

U.S. Appl. No. 12/506,957, Erica Callahan, "Article of Footwear Having an Undulating Sole", filed Jul. 21, 2009.

U.S. Appl. No. 12/748,246, Matthew Boudreau, "Article of Footwear with Support Element", filed Mar. 26, 2010.

U.S. Appl. No. 12/832,464, Erica Callahan, "Article of Footwear and Methods of Making Same", filed Jul. 8, 2010.

Office Action dated Aug. 12, 2011 from U.S. Appl. No. 29/362,605, Vestuti et al., Shoe and Portion of Shoe, filed May 27, 20010.

Office Action dated Sep. 13, 2011 from U.S. Appl. No. 29/345,964, Pope, Portion of a Shoe, filed Oct. 23, 2009.

* cited by examiner

SOLE AND ARTICLE OF FOOTWEAR

CROSS-REFERENCE TO RELATED APPLICATION

This application is a continuation of U.S. patent application Ser. No. 14/203,133, filed Mar. 10, 2014, titled "Sole and Article of Footwear," which is a continuation of U.S. patent application Ser. No. 12/980,961, filed Dec. 29, 2010, titled "Sole and Article of Footwear." Each of these applications is incorporated herein in its entirety by reference thereto.

BACKGROUND OF THE INVENTION

1. Field of the Invention

The present invention is directed to an article of footwear having a sole.

2. Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to provide cushioning to the wearer's foot and to protect it from these forces. To achieve adequate cushioning, many footwear soles are relatively thick and heavy. When sole size and/or weight are reduced to achieve other performance goals, protection of the wearer's foot is often compromised.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole which absorbs shocks. Therefore, a continuing need exists for innovations in providing cushioning and support to articles of footwear.

BRIEF SUMMARY OF THE INVENTION

Embodiments of the present invention relate to a sole and an article of footwear having a sole. In one embodiment, the article of footwear may comprise: an upper; an outer midsole having a base coupled to the upper, and a rim portion extending from the periphery of the base, wherein the rim portion defines a plurality of spaced apart gaps; and an inner midsole disposed interiorly to the rim portion, wherein a portion of the inner midsole is disposed in at least one gap. The inner midsole may be discrete from the outer midsole.

In one embodiment, a sole for an article of footwear comprises: a base having a medial side, a lateral side, and a periphery; a rim portion extending from the periphery of the base, the rim portion having a top surface and a bottom surface, and wherein the rim portion undulates to define a plurality of spaced apart gaps in the top surface and a plurality of spaced apart gaps in the bottom surface; and a core member disposed interiorly to the rim portion, the core member having a top surface and a bottom surface, and wherein the core member undulates to define a plurality of spaced apart gaps in the top surface and a plurality of spaced apart gaps in the bottom surface.

In yet another embodiment, a sole for an article of footwear comprises: a foam midsole having a base and an undulating rim portion extending from a periphery of the base along a medial side and a lateral side; and a core member disposed interiorly to the undulating rim portion, wherein the midsole material has at least one different characteristic than the core member material. The different material characteristic may include at least one of hardness, density, and modulus.

In another embodiment, an article of footwear may comprise: an upper; an outer midsole having a base coupled to the upper, a forefoot pod, a heel pod, and a plurality of outer protrusions extending from the periphery of the base between the forefoot pod and the heel pod; and an inner midsole disposed interiorly to the outer protrusions, the inner midsole having a plurality of bars each extending a portion of the width of the base between the outer protrusions.

In one embodiment, a sole for an article of footwear comprises: a base having a periphery; a plurality of outer protrusions extending from the periphery of the base; and a core member disposed interiorly to the outer protrusions and having a plurality of horizontally elongated protrusions extending horizontally across a portion of the width of the base between the outer protrusions.

In still another embodiment, a sole for an article of footwear comprises: a base having a periphery, a heel end, and a forefoot end; a plurality of outer protrusions extending from the medial and lateral periphery of the base at an angle toward the heel end, wherein a gap is disposed between adjacent outer protrusions; and a core member disposed between the medially and laterally disposed outer protrusions and having a plurality of substantially rectangular protrusions extending across a portion of the width of the base between the outer protrusions.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
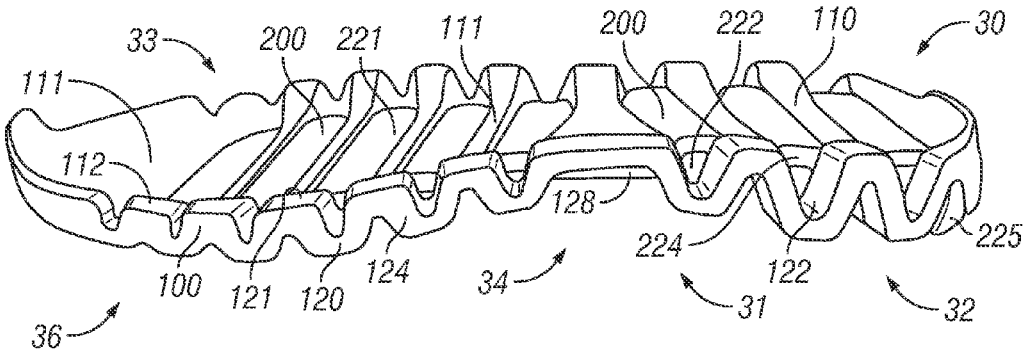
FIG. 1 is a medial side perspective view of a sole according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Figure 2:
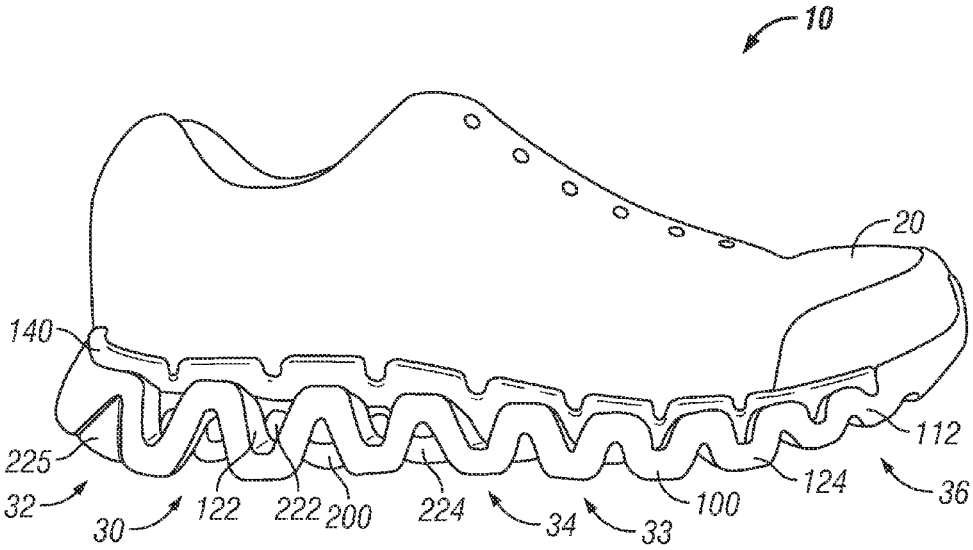
FIG. 2 is a lateral side view of an article of footwear having the sole of FIG. 1 according to an embodiment of the present invention.

Embodiments of the present invention include an article of footwear 10 having an upper 20 and a sole 30 attached to the upper 20. With reference to FIGS. 1 and 2, the sole 30 includes an outer midsole 100 and an inner midsole 200, and generally includes a heel region 32, a midfoot region 34, and a forefoot region 36, and a medial side 31 and a lateral side 33. The outer midsole 100 and the inner midsole 200 may be shaped and sized to provide a desired combination of cushioning, stability, and ride characteristics to the article of footwear. The term "ride" may be used herein in describing some embodiments as an indication of the sense of smoothness or flow occurring during a gait cycle including heel strike, midfoot stance, toe off, and the transitions between these stages. Some embodiments of the present invention may provide particular ride features including, but not limited to, appropriate control of pronation and supination, support of natural movement, support of unconstrained or less constrained movement, appropriate management of rates of change and transition, and combinations thereof.

Figure 3:
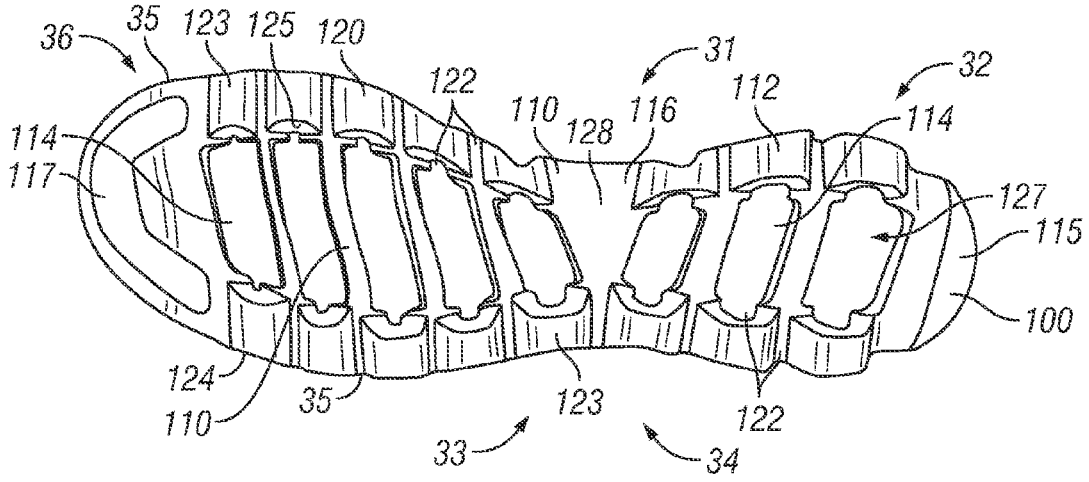
FIG. 3 is a bottom view of an outer midsole according to an embodiment of the present invention.

In one embodiment, the outer midsole 100 includes a base 110 and a rim portion 120 extending from the base 110. The base 110 may be attached to the upper 20 by adhesive bonding, welding, or other suitable technique, and may include a top surface 111 generally shaped to accommodate the contours of the foot. The rim portion 120 defines a plurality of spaced apart gaps 122. In one embodiment, the rim portion 120 may include a top surface 121 and a bottom surface 123, and the rim portion 120 may undulate such that one or more of the plurality of gaps 122 may be formed in the top surface 121 and/or one or more of the gaps 122 may be formed in the bottom surface 123. In this manner, the rim portion 120 may be substantially sinusoidal. In one embodiment, the area between adjacent gaps 122 formed in the top surface 121 may be described as a peak, and the area between adjacent gaps 122 formed in the bottom surface 123 may be described as a trough. The rim portion 120 may include an outer sidewall 124 and, as shown in FIG. 3, an inner sidewall 125, and all or a portion of the outer sidewall 124 and/or the inner sidewall 125 may be substantially sinusoidal. In some embodiments, as shown, for example, in FIG. 5, portions of the outer sidewall 124 may angle inwardly and/or outwardly from the sole 30.

In one embodiment, at least a portion of the rim portion 120 may extend from all or a portion of the perimeter 112 of the base 110. In one embodiment, the rim portion 120 extends from the perimeter 112 of the base 110 from the forefoot region 36 to the heel region 32, as shown, for example, in FIG. 1. In other embodiments, the rim portion 120 extends from the midfoot region 34 to the heel region 32, or from the forefoot region 36 to the midfoot region 34. In one embodiment, the rim portion 120 may extend from the base 110 along the entire length of the base. In one embodiment, the rim portion 120 extends from the perimeter 112 of the base 110 on the medial side 31 and the lateral 33 side of the sole 30. In other embodiments, the rim portion 120 may only extend along the medial side 31 or the lateral side 33.

With reference to FIG. 3, a plurality of voids 114 may be formed in the base 110. The outer midsole 100 may also include larger areas, such as, for example, a toe pod 117, a midfoot pod 116, and a heel pod 115, and a plurality of voids 114 may be disposed therebetween. In one embodiment, one or more of the voids 114 may be disposed interiorly to the rim portion 120. The voids 114 may be varied in size and shape, or, in one embodiment, may be uniform. In one embodiment, the voids 114 may have a generally quadrilateral (e.g., rectangular) shape. The voids 114 may be formed at an angle relative to the longitudinal axis of the base 110. For example, as shown in FIG. 3, one or more forward most voids 114 may be disposed at an angle with the medial side closer to the forefoot region 36, and one or more rear most voids 114 may be disposed at an angle with the lateral side closer to the forefoot region 36. The angle of the voids 114 may vary depending on the orientation of the inner midsole 200 which may be disposed in the voids 114, as discussed below. In another embodiment, one or more voids 114 may be formed substantially perpendicular relative to the longitudinal axis of the base 110.

One or more of the voids 114 may be disposed adjacent to a gap 122, and, in one embodiment, may bleed into an adjacent gap 122. For example, as shown in FIG. 3, a void 114 may bleed into an adjacent gap 122 formed in the top surface 121 of the rim portion 120. In one embodiment, at least a portion of the outer sidewall 124 of the rim portion 120 may be formed along an outer edge 35 of the base. In one embodiment, at least a portion of the outer sidewall 124 may be flush with the outer edge 35 of the base 110. In other embodiments, the outer sidewall 124 may be disposed inwardly from the outer edge 35, or may extend outwardly beyond the outer edge 35.

Figure 4:
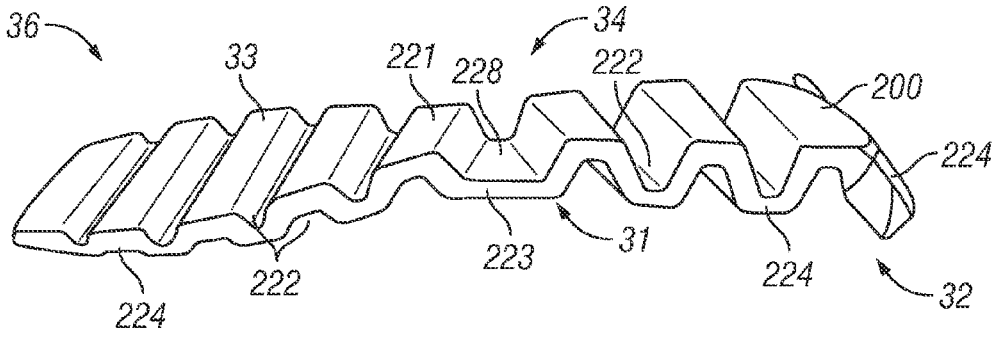
FIG. 4 is a medial side perspective view of an inner midsole according to an embodiment of the present invention.

With reference to FIGS. 1 and 4, all or a portion of the inner midsole 200 is disposed interiorly to the rim portion 120. The inner midsole 200 may include a top surface 221 and a bottom surface 223. All or a portion of the top surface 221 may be generally shaped to conform with the contours of the top surface 111 of the base 110 and/or shaped to accommodate the foot.

The size and shape of the inner midsole 200 may be varied depending on the desired characteristics of the sole. In one embodiment, as shown in FIG. 4, the inner midsole 200 defines a plurality of spaced apart gaps 222. In one embodiment, the inner midsole 200 may include a top surface 221 and a bottom surface 223. In one embodiment, the inner midsole 200 may undulate such that one or more of the plurality of gaps 222 may be formed in the top surface 221 and/or one or more of the gaps 222 may be formed in the bottom surface 223. In this manner, the inner midsole 200 may be substantially sinusoidal. In one embodiment, the area between adjacent gaps 222 formed in the top surface 221 may be described as a peak, and the area between adjacent gaps 222 formed in the bottom surface 223 may be described as a trough. In one embodiment, the inner midsole 200 may include an outer sidewall 224 and all or a portion of the sidewall 224 may be substantially sinusoidal.

In one embodiment, the top surface 221 between adjacent gaps 222 (i.e., peaks) may have a generally quadrilateral (e.g., rectangular) shape, as shown, for example, in FIG. 4. The peaks may be formed at an angle relative to the longitudinal axis of the inner midsole 200. For example, as shown in FIG. 4, one or more forward most peaks may be disposed at an angle with the medial side closer to the forefoot region 36, and one or more rear most peaks may be disposed at an angle with the lateral side closer to the forefoot region 36. The angle of the inner midsole generally may vary. In another embodiment, the peaks may be formed substantially perpendicular relative to the longitudinal axis of the inner midsole 200.

The inner midsole 200 and the outer midsole 100 comprise material for providing the desired cushioning, ride, and stability of the sole 30. Suitable material for the inner midsole 200 and the outer midsole 100 may include, but is not limited to, foam and thermoplastic polyurethane. When the inner midsole 200 and/or the outer midsole 100 are a foam, the foam may comprise, for example, ethyl vinyl acetate (EVA) based foam or polyurethane (PU) based foam and the foam may be an open-cell foam or a closed-cell foam. In other embodiments, the inner midsole 200 and/or the outer midsole 100 may comprise elastomers, thermoplastic elastomers (TPE), foam-like plastic, and gel-like plastics. Suitable materials for inner midsole 200 and/or outer midsole 100 may be obtained from, for example, Eclipse Polymers Co., Sung Shin Co., and Korea Fine Chemical Co.

In one embodiment, the inner midsole 200 and the outer midsole 100 may comprise different materials to provide different characteristics to different portions of the sole 30. In one embodiment, the inner midsole 200 and the outer midsole 100 may have different hardness characteristics. For example, in one embodiment it may be desirable for the sole 30 to be stiffer near the periphery of the sole to provide required lateral and/or medial stability. In this manner, all or a portion of the rim portion 120 may comprise a harder material than inner midsole 200.

In some embodiments, the material hardness of the outer midsole 100 (e.g., the base 110 and/or the rim portion 120) may range from about 50 Asker C to about 70 Shore D, for example, about 60C to about 75C or about 65C to about 70C. In some embodiments, the material hardness of the inner midsole 200 may range from about 20C to about 70C, for example, about 40C to about 60C or about 50C to about 55C. In some embodiments, the material hardness of the outer midsole 100 may range from about 50 Asker C to about 70 Shore D and the material hardness of the inner midsole 200 may range from about 20C to about 70C, for example, the material hardness of the outer midsole 100 may range from about 60C to about 75C and the material hardness of the inner midsole 200 may range from about 40C to about 60C.

In some embodiments, the material density of the outer midsole 100 may be about 0.3 to about 0.5 grams/cubic centimeter ($g/cm^3$), for example, such as about 0.35 to about 0.4 $g/cm^3$. In some embodiments, the material density of the inner midsole 200 may be about 0.25 to about 0.5 $g/cm^3$, for example, such as about 0.25 to about 0.3 $g/cm^3$. In some embodiments, the material density of the outer midsole 100 is higher than the material density of the inner midsole 200. For example, in one embodiment, the material density of the outer midsole 100 is about 0.35 to about 0.4 $g/cm^3$ and the material density of the inner midsole 200 is about 0.25 to about 0.3 $g/cm^3$. In other embodiments, the material density of the outer midsole 100 is lower than, or even equal to, the material density of the inner midsole 200.

In some embodiments, the outer midsole 100 material has a higher modulus than that of the inner midsole 200 material. In other embodiments, the outer midsole 100 material has a modulus that is lower, or even equal to, that of the inner midsole 200 material.

The inner midsole 200 and the outer midsole 100 may be formed using suitable techniques, including, but not limited to, injection molding, blow molding, compression molding, and rotational molding. The inner midsole 200 and the outer midsole 100 may be discrete components that are formed separately and attached. In one embodiment, the inner midsole 200 may be attached to the outer midsole 100 by adhesive bonding, welding, or other suitable technique. For example, the inner midsole 200 may be attached to the base 110 and/or the rim portion 120. In another embodiment, the inner midsole 200 and the outer midsole 100 may be monolithic and may be integrally formed as a unitary structure. For example, the inner midsole 200 and the outer midsole 100 may be co-molded and thereby formed together simultaneously. In one embodiment, as shown in FIG. 3, the base 110 and the rim portion 120 may define a cavity 127 for receiving the inner midsole 200.

Figure 11:
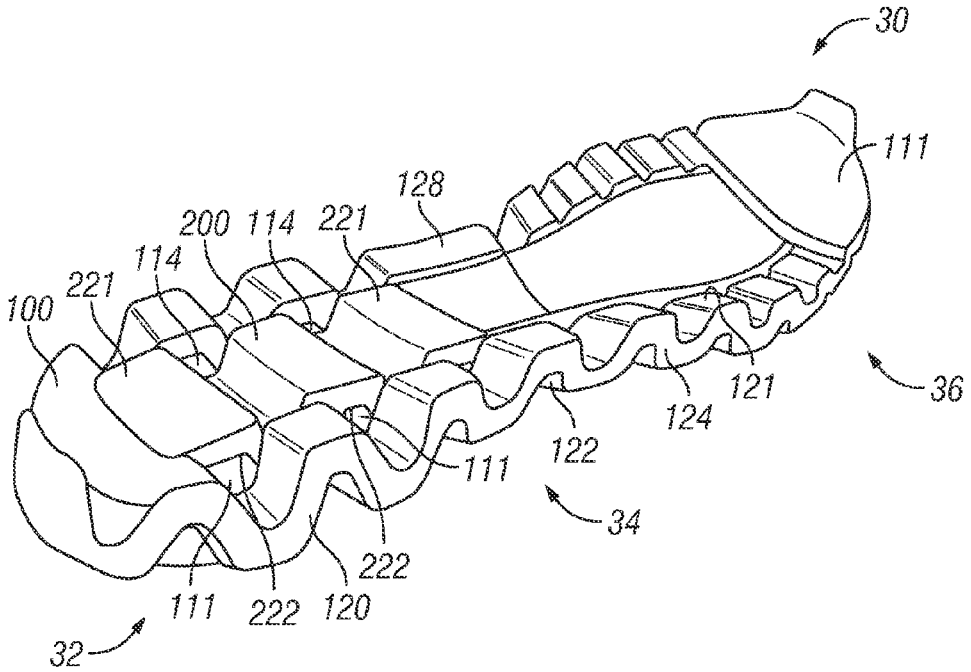
FIG. 11 is a perspective view of a sole according to an embodiment of the present invention.
Figure 12:
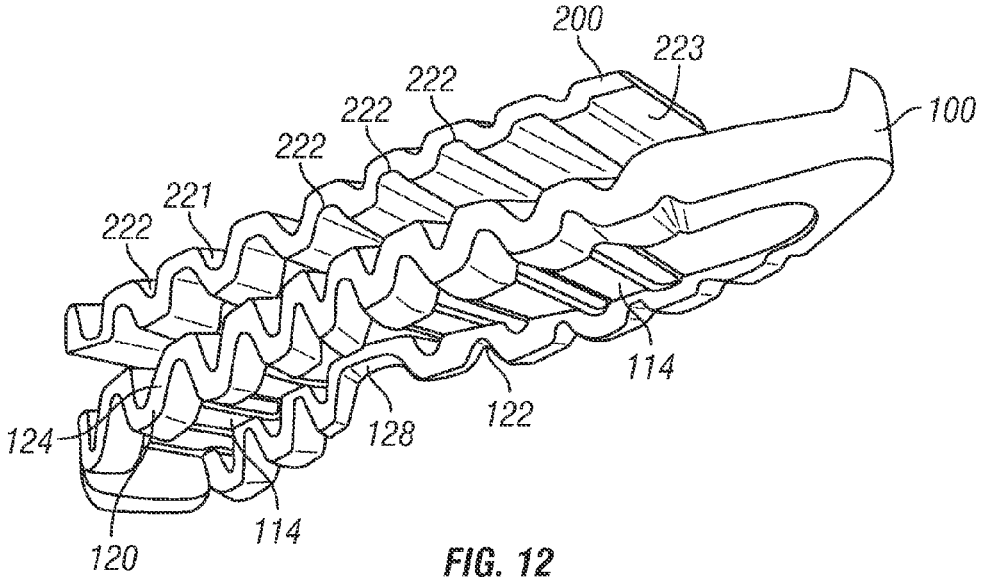
FIG. 12 is a exploded bottom perspective view of the sole of FIG. 11 according to an embodiment of the present invention.

The physical connection, interrelation or "overlap" between the outer midsole 100 and the inner midsole 200 may be varied to provide the desired characteristics for the sole 30. In one embodiment, a portion of the inner midsole 200 may be disposed in one or more voids 114 in the base 110. With reference to FIGS. 1 and 4, a portion of the inner midsole 200 between adjacent gaps 222 in the top surface 221 (i.e., a peak)

may be disposed in one or more voids 114 in the base 110. In this manner, portions of the base 110 in between voids 114 may be disposed in gaps 222 in the top surface 221 and the inner midsole 200 may be referred to as being bottom loaded. In another embodiment, as shown, for example, in FIGS. 11 and 12, a portion of the inner midsole 200 between adjacent gaps 222 in the bottom surface 223 (i.e., a trough) may extend through one or more voids 114 in the base 110. In some embodiments, these portions of the inner midsole 200 may contact the ground during use. The portion of the inner midsole 200 between adjacent gaps 222 in the top surface 221 (i.e., one or more peaks) may be disposed above the base 110. In this manner, portions of the base 110 in between voids 114 may be disposed in gaps 222 in the bottom surface 223 and the inner midsole 200 may be referred to as being top loaded. In one embodiment, the inner midsole 200 may fit snugly within the one or more voids 114 such that adhesive is not required. In other embodiments, the inner midsole 200 may be directly attached to the upper 20.

Figure 5:
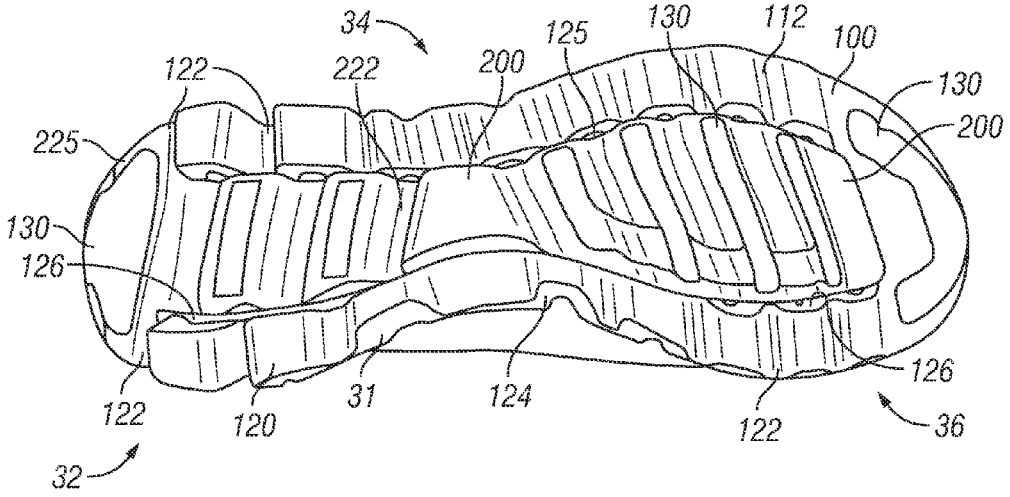
FIG. 5 is a bottom view of an article of footwear having the sole of FIG. 1 according to an embodiment of the present invention.

In one embodiment, a portion of the inner midsole 200 is disposed in one or more of the gaps 122 formed in the rim portion 120. The inner midsole 200 may be disposed in a gap 122 defined by the top surface 111 and/or a gap 122 defined by the bottom surface 123. For example, with reference to FIGS. 1, 2, and 4, an extension 225 of the inner midsole may be disposed in the rearmost gap 122 in the rim portion 120. In this manner, the inner midsole may provide increased stability to the rim portion 120 at a particular location of the outer midsole and/or may provide better overall ride of the footwear. In one embodiment, the extension 225 may be disposed in a gap 122 on the medial side 31 or the lateral side 33 of the sole. In one embodiment, as shown in FIGS. 1 and 5, the extension 225 may be disposed in a gap 122 on both the medial side 31 and the lateral side 33 of the sole. In some embodiments, the inner midsole 200 may be disposed in more than one gap 122. In one embodiment, the inner midsole 200 may be disposed in the two rearmost gaps 122. In another embodiment, as shown, for example, in FIGS. 7 and 8, the inner midsole 200 may include multiple extensions 225 such that the inner midsole may be disposed in the three rearmost gaps 122. Other variations may be provided, including, but not limited to, the inner midsole 200 disposed in one or more gaps 122 in the heel region 32, midfoot region 34, and the forefoot portion 36. In other embodiments, a portion of the outer midsole 100 may be disposed in one or more of the gaps 222 formed in the inner midsole 200. In this manner, the outer midsole 100 may provide increased stability to a particular inner portion of the sole 30 and/or may provide better overall ride of the footwear.

The amount that the inner midsole 200 extends into the gap 122 may be varied depending on the desired characteristics of the sole. In one embodiment, the inner midsole may be disposed in the gap 122 such that the inner midsole is substantially flush with the outer sidewall 124 of the outer midsole 100, as shown, for example, in FIG. 2. In other embodiments, the inner midsole may be disposed in the gap 122 such that the inner midsole extends only partially within the gap 122.

Figure 6:
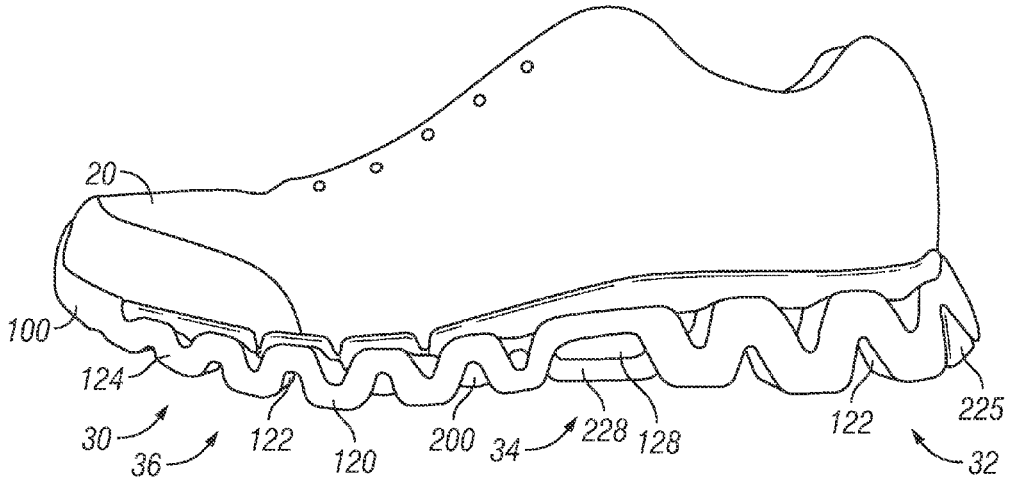
FIG. 6 is a medial side view of an article of footwear having the sole of FIG. 1 according to an embodiment of the present invention.

The size and shape of the gaps 122 in the rim portion 120 and the gaps 222 in the inner midsole 200 may be varied to provide the desired characteristics for the sole 30. In one embodiment, as shown for example in FIG. 1, the width and depth of gaps 122 may vary along the length of the rim portion 120. For example, gaps 122 may be wider and deeper in the heel region 32, and generally become more narrow and shallow toward the forefoot region 36. In this manner, the rim portion 120 may deform more, and, thereby, provide increased cushioning in the heel region 32, where greater impact forces may be experienced during the gait cycle, and/or may provide better overall ride of the footwear. In one embodiment, as shown in FIGS. 1 and 6, a larger midfoot gap 128 may be provided in the midfoot region 34 on the medial side 31 of the rim portion 120. The midfoot gap 128 may be formed in the bottom surface 123, and, in some embodiments, may allow for better deformation of the outer midsole 100 during gait cycle transitions and/or may provide weight saving to the article of footwear 10 because this area of the sole may not be subject to the higher forces to which the heel and toe areas may be subject. In one embodiment, as shown in FIG. 4, the inner midsole 200 may include a corresponding larger midfoot gap 228 defined by the top surface 221.

In one embodiment, gaps 122 and 222 may be substantially U-shaped such that each gap is more narrow and rounded at the closed end and wider at the open end. The embodiments described above are merely exemplary and gaps 122 and gaps 222 may have any combination of shapes as would be apparent to one of ordinary skill in the art. For example, in one embodiment rim portion 120 and/or inner midsole 200 may include a combination of v-shaped and omega-shaped gaps.

In some embodiments, the material used for the outer midsole 200 and the inner midsole 100 may be varied and may determine the desired shape, width and spacing of the gaps 122 and gaps 222. For example, in one embodiment if a harder material is used for the rim portion 120, the gaps 122 may be spaced further apart. Other geometries of the outer midsole 100 and the inner midsole 200 may be altered depending on the hardness, the density, or the modulus of the materials used. For example, the height of the undulations in the sole 30 (e.g., peaks and troughs); the height of projections extending from the sole 30; whether and how the projections/undulations are connected or joined; the width or cross-sectional areas of projections/undulations (e.g., at the point of attachment to the base or at the ground contacting surface); and the number of projections/undulations. In some embodiments, the thickness (or cross sectional area) of the rim portion 120 and/or the inner midsole 200 may vary. For example, the undulations in the outer midsole 100 and the inner midsole 200 may be thicker on the medial side to influence stability or ride, as shown, for example, in FIGS. 5 and 6.

As best shown in FIG. 5, in one embodiment a space 126 is disposed between the inner midsole 200 and the outer midsole 100. For example, the space 126 may be disposed between the sidewall 224 of the inner midsole 200 and the inner sidewall 125 of the rim portion 120. In one embodiment, the space 126 may be narrower proximate the base 110 and wider at the ground contacting end such that the space resembles an upside-down V-shaped notch. In other embodiments, the space 126 may have a uniform width at a particular location in the sole 30. The space 126 may allow movement of the rim portion 120 relative to the inner midsole 200, which may provide for the desired cushioning and feel of the sole 30 to the user during a gait cycle. For example, the space 126 may allow the rim portion 120 at the location of the space to splay in multiple directions—outwardly from and inwardly toward the sole—when under a compressive load during use, and thereby allow for a tailored cushioning effect (e.g., allow for increased cushioning) and/or provide better overall ride of the footwear. In one embodiment, the space 126 may be disposed along all or a portion of the length of the sidewall 224 of the inner midsole 200 on one or both of the medial side 31 and the lateral side 33 of the sole depending on the desired characteristics. In one embodiment, the width of the space 126 may vary along the sidewall for desired characteristics. For example, along the medial side 31 of the sole where less movement of the rim portion 120 relative to the inner midsole 200 may be desired to provide increased stability or improved ride, the width of the space may be narrower than at other locations of the sole 30. In other embodiments, portions of the sidewall 224 of the inner midsole 200 and portions of the inner sidewall 125 of the rim portion 120 may be made to directly abut each other.

Figure 9:
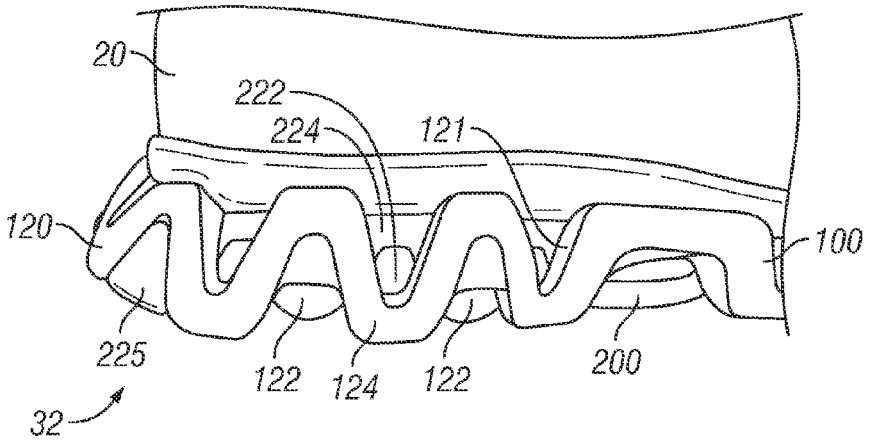
FIG. 9 is a partial close-up medial side view of an article of footwear according to an embodiment of the present invention.

In one embodiment, a portion of one or more gaps 122 may be filled or partially filled with the outer midsole 100. For example, as shown in FIG. 9, one or more gaps 122 on the medial side 31 in the heel region 32 may be filled to provide the desired cushioning and stability. The gaps 122 may be filled from the upper closed portion of the gap downward or may be filled from the lower open end upward. Similarly, in one embodiment, one or more gaps 222 may be filled or partially filled with the inner midsole 200.

Figure 10:
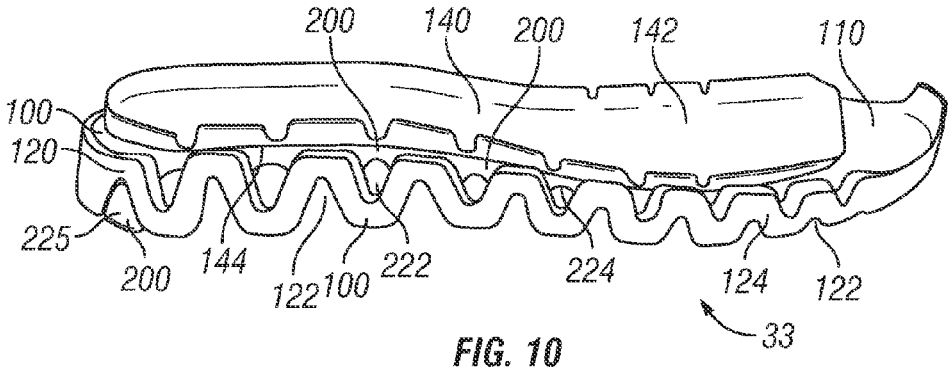
FIG. 10 is a side view of a plate and sole according to an embodiment of the present invention.

In one embodiment, as shown in FIG. 10, the article of footwear 10 may further include a plate 140 disposed between the outer midsole 100 and the upper 20. The plate 140 may include an upper surface 142 generally shaped to accommodate the foot and a lower surface 144. The lower surface 144 may be shaped to receive the base 110 and/or the top surface 221 of the inner midsole 200. The plate 140 may comprise any suitable thermoplastic material or composite material and, in some embodiments, may be manufactured through molding or lay-up. In other embodiments, plate 140 may be a molded foam, such as a compression molded foam, TPU, or Pebax®. In one embodiment, the plate 140 may be made of a stiffer material than the sole 30. In one embodiment, the plate 140 may be formed separately from outer midsole 100 and/or inner midsole 200 and then attached to the sole 30 through adhesive bonding, welding, or other suitable techniques as would be apparent to one of ordinary skill in the art. For example, the plate 140 may be attached to the base 110, the rim portion 120, and/or the inner midsole 200. In another embodiment, the plate 140 and one or both of the outer midsole 100 and the inner midsole 200 may be co-molded and thereby formed together simultaneously. In one embodiment, the plate 140 may be a full foot plate such that it substantially covers the top surface of the sole 30. In other embodiments, the plate 140 may be a partial foot plate accommodating portions of the heel region 32, the midfoot region 34, and the forefoot region 36, and combinations thereof For example, the plate 140 may accommodate the heel region 32 and the midfoot region 34, or the heel region 32 only. In some embodiments, the plate 140 may include hinges (e.g., natural hinges), scoring, grooves, or cuts (e.g., cuts that extend (lateral-to-medial or medial-to-lateral) partially across the plate) to allow for movement of the plate 140.

Figure 7:
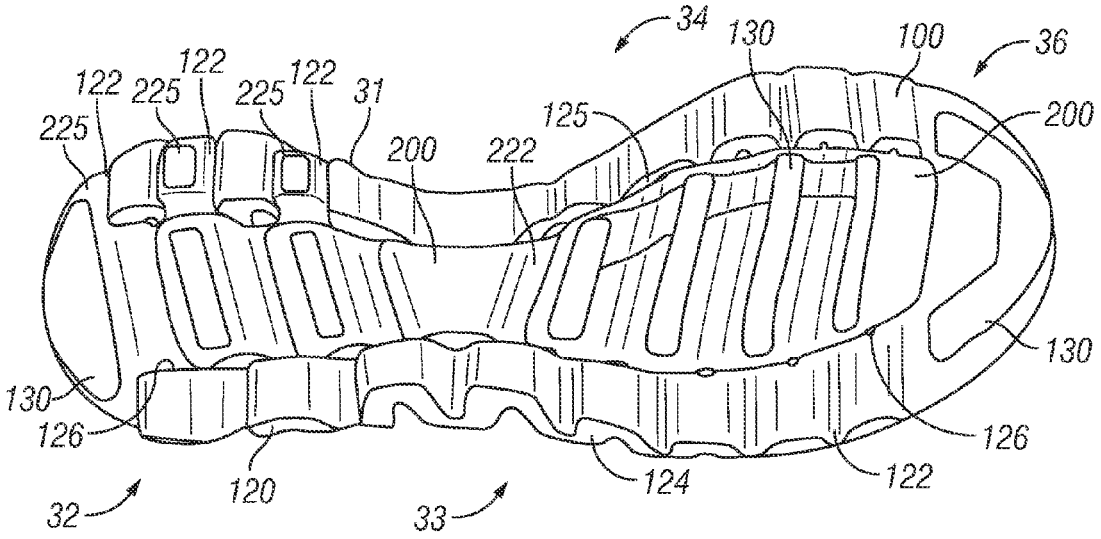
FIG. 7 is a bottom view of an article of footwear according to an embodiment of the present invention.
Figure 8:
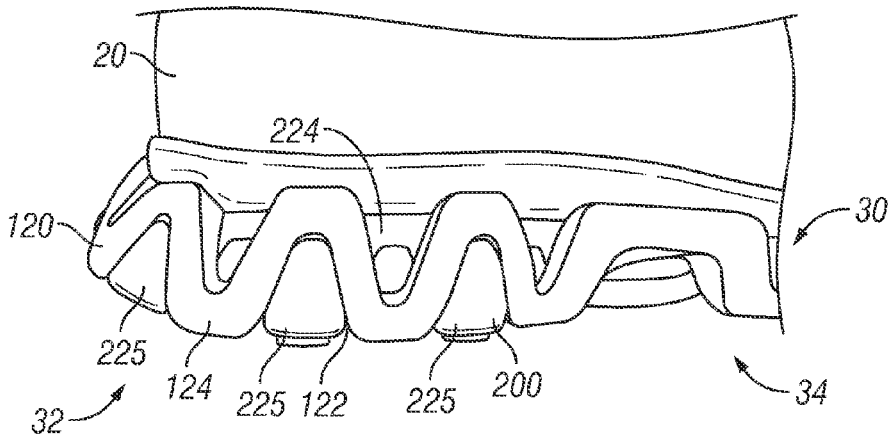
FIG. 8 is a partial close-up medial side view of the article of footwear of FIG. 7 according to an embodiment of the present invention.

All or a portion of one or both of the inner midsole 200 and the outer midsole 100 may contact the ground during use of the article of footwear 10. In one embodiment, a portion of the bottom surface 123 of the rim portion 120 in between adjacent gaps 122 may contact the ground, and a portion of the bottom surface 223 of the inner midsole 200 between adjacent gaps 222 may contact the ground. The ground contacting portions of the outer midsole 100 and the inner midsole 200 may be substantially flat, or may be slightly rounded or crowned. In embodiments of the present invention, as shown in FIGS. 5 and 7, an outsole 130 may be disposed on all or a portion of the outer midsole 100 and/or the inner midsole 200. In some embodiments, outsole 130 may be disposed on areas of the sole 30 subjected to heavy wear, including but not limited to, a toe area, a midfoot area corresponding to the ball of the foot, and a heel portion. The outsole 130 may comprise a wear resistant material, including, but not limited to, synthetic or natural rubber, polyurethane (e.g., thermoplastic polyurethane (TPU)), foam (e.g., a wear-resistant foam), or a combination thereof, or any suitable material typically utilized for an outsole to provide additional traction and wear resistance. In one embodiment, the outsole 130 may comprise a high abrasion rubber compound, such as, for example, Shin Ho KA2BF. In some embodiments, the sole 30 and the outsole 130 may be formed of the same or different material. In one embodiment, the outsole 130 may be formed separately from the inner midsole 200 and/or the outer midsole 100 and attached, or they may be molded together to form a unitary structure.

In embodiments of the present invention, a portion of the inner midsole 200 may be visible from the exterior of the article of footwear 10 through a gap 122. For example, as shown in FIG. 2, a portion of the sidewall 224 may be visible through one or more gaps 122. In one embodiment of the present invention in which the outer midsole 100 and the inner midsole 200 are substantially sinusoidal, the outer and inner midsoles may be substantially out of phase such that a gap 122 defined by the upper surface 121 of the rim portion 120 aligns with a gap 222 defined by the bottom surface 223 of the inner midsole 200. In this manner, a peak defined by the outer midsole 100 may align with a trough defined by the inner midsole 200.

Figure 13:
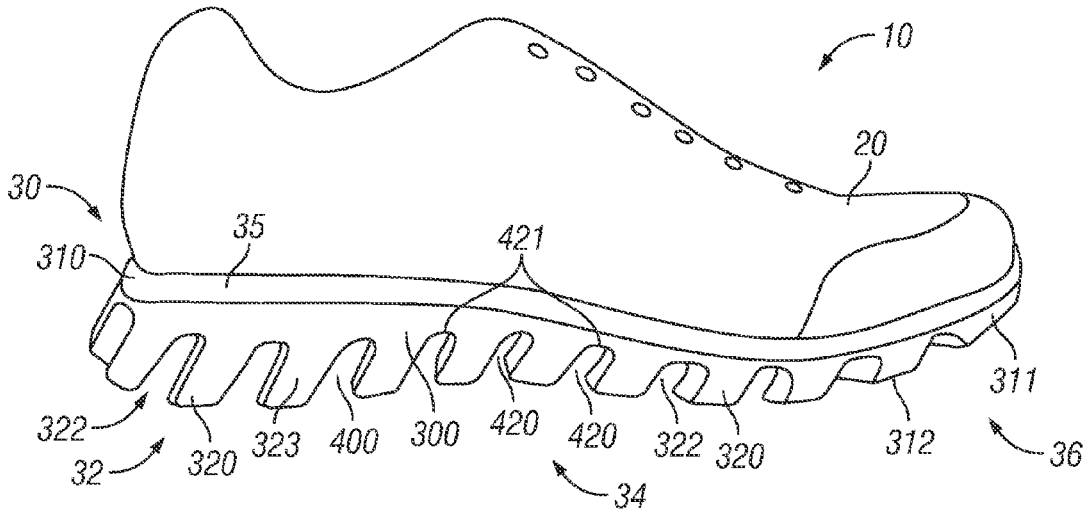
FIG. 13 is a side view of an article of footwear according to an embodiment of the present invention.
Figure 14:
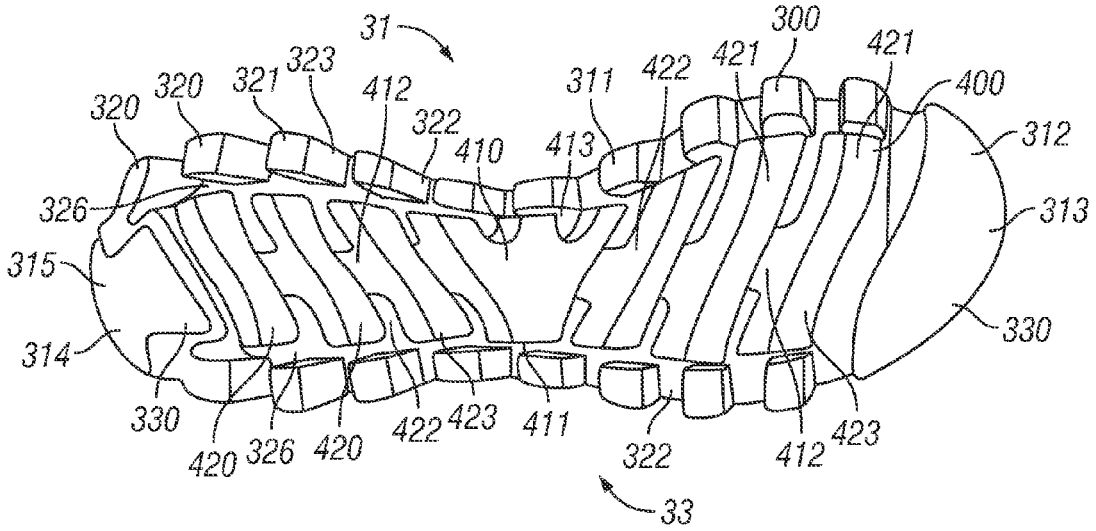
FIG. 14 is a bottom view of the article of footwear of FIG. 13 according to an embodiment of the present invention.
Figure 15:
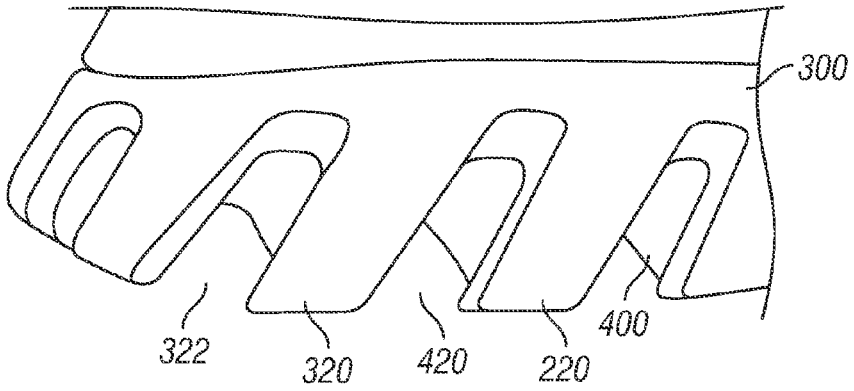
FIG. 15 is a partial close-up view of the article of footwear of FIG. 13 according to an embodiment of the present invention.

Embodiments of the present invention will now be described with reference to FIGS. 13-21, in which like reference numerals refer to like elements. The embodiments of FIGS. 13-21 may include some or all of the features of other embodiments of the present invention described herein. With reference to FIGS. 13-15, the sole 30 includes an outer midsole 300 and an inner midsole 400, and generally includes a heel region 32, a midfoot region 34, and a forefoot region 36, and a medial side 31 and a lateral side 33. The outer midsole 300 and the inner midsole 400 may be shaped and sized to provide a desired combination of cushioning, stability, and ride characteristics to the article of footwear.

In one embodiment, the outer midsole 300 includes a base 310 and a rim portion defined by a plurality of outer protrusions 320 extending from the base 310. The base 310 may be attached to the upper by adhesive bonding, welding, or other suitable technique. Some or all of the outer protrusions 320 may be disposed about all or a portion of the perimeter 311 of the base 310. In this manner, the outer protrusions 320 may be formed along the outer edge 35 of the base 310. For example, as shown best in FIG. 14, a plurality of outer protrusions 320 may be formed about the perimeter 311 of the base 310 on the medial side 31 of sole 30 and the lateral side 33 of the sole. In one embodiment, the outer sidewall 323 of one or more outer protrusions 320 may be flush with the outer edge 35 of the base 310. In other embodiments, the outer sidewall 323 may be disposed inwardly from the outer edge 35, or may extend outwardly beyond the outer edge 35.

In one embodiment, one or more outer protrusions 320 are columnar in shape. For example, the protrusions generally may have four sides, which may include outer sidewall 323, that extend downwardly from the base 310, and may have a generally square or quadrilateral cross-section, as shown, for example, in FIG. 14. As such, in one embodiment the bottom surface 321 of a protrusion 320 may be generally square or quadrilateral in shape. In other embodiments, the outer protrusions 320 may have other cross-sectional shapes, including, but not limited to, round, circular, oval, triangular, elliptical, hexagonal, and polygonal. In one embodiment, one or more outer protrusions 320 may have different shapes. The outer protrusions 320 may also be differently sized. For example, as shown in FIG. 13, the outer midsole 300 may include longer outer protrusions 320 toward the heel region 32 of the sole, and shorter outer protrusions 320 toward the forefoot region 36. In other embodiments, one or more outer protrusions 320 may be wider at a portion of the sole 30 to provide desired cushioning and stability. For example, outer protrusions 320 in the heel region 32 and the forefoot region 36 may be wider than protrusions in the midfoot region 34. In another embodiment, outer protrusions 320 may be wider on the medial side 31 or lateral side 33 of the sole to provide desired stability and/or better overall ride.

The outer midsole 300 may define a plurality of spaced apart gaps 322 such that one or more adjacent outer protrusions 320 may be spaced apart by gaps 322. In one embodiment, the gaps 322 are each of the same size such that the perimeter protrusions 320 are evenly spaced. In alternative embodiments, the width of some or all of the gaps 322 may be different. For example, in embodiments in which one or more outer protrusions 320 may be wider at a portion of the sole 30 to provide desired cushioning and stability, gaps 322 may correspondingly be narrower. In one embodiment, gaps 322 may generally have the same width as an adjacent outer protrusion 320. In other embodiments, gaps 322 may be wider or narrower than the protrusions. For example, in some embodiments, gaps 322 are at least about one-quarter of the width of one or both of adjacent protrusions. In other specific embodiments, gaps 322 are at least about one-half of the width of one or both of adjacent protrusions. In yet other embodiments, gaps 322 are at least about the same as, at least about 1.25 times, or at least about 1.5 times the width of one or both of adjacent protrusions.

In one embodiment, the gaps 322 may extend in between adjacent protrusions from the bottom surface 321 of the protrusions 320 to the base 310. In other embodiments, a portion of the gap 322 may be filled. For example, material may be disposed between adjacent protrusions such that the gap 322 between them extends only partially up from the bottom surface 321. In some embodiments, the depths of a majority of the gaps 322 (e.g., substantially all of the gaps) are at least as deep (from ground contact surface to base) as each of those gaps are wide between adjacent projections. In other embodiments, the majority of the gaps 322 located in a heel region (e.g., substantially all of the gaps in a heel region) are at least as deep as those gaps are wide. For example, in one embodiment, the majority of the gaps 322 located in a heel region (e.g., substantially all of the gaps in a heel region) are at least about 1.5 to about 2 times as deep as those gaps are wide. In some embodiments, the depth of the gaps increases progressively from the toe region to the heel region. For example, in one specific embodiment, at least one gap in a toe region is at least as deep as that gap is wide; at least one gap located in the heel region is at least about 1.5 to about 2 times as deep as that gap is wide; and a plurality of gaps between the at least one gap in the toe region and the at least one gap located in the heel region are at least about 1 to about 2 times as deep as those gaps are wide.

Figure 16:
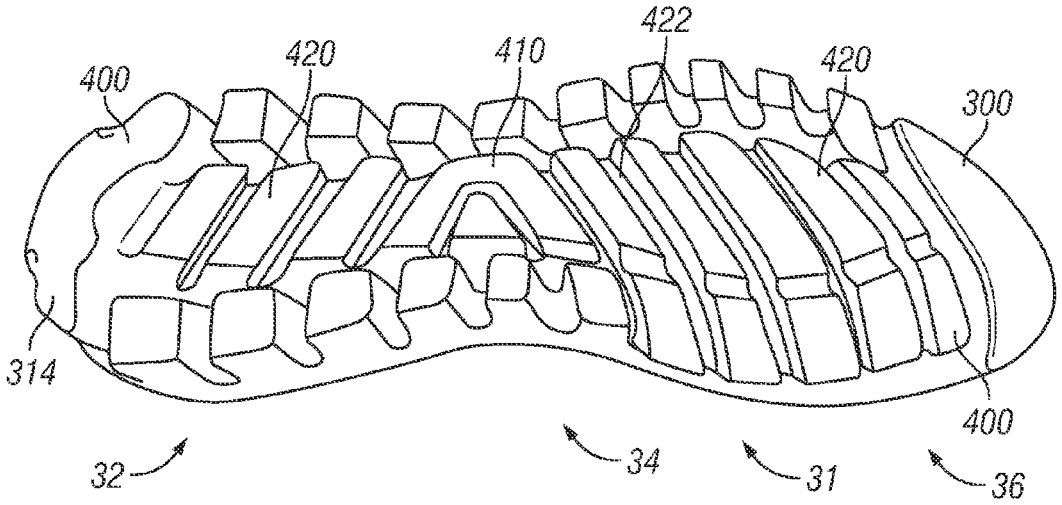
FIG. 16 is a bottom view of a sole according to an embodiment of the present invention.
Figure 17:
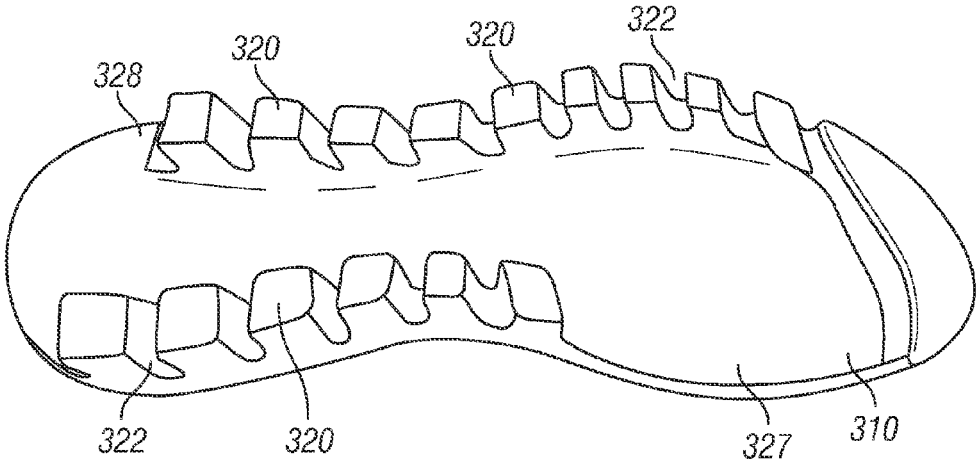
FIG. 17 is a bottom view of an outer midsole of the sole of FIG. 16 according to an embodiment of the present invention.
Figure 18:
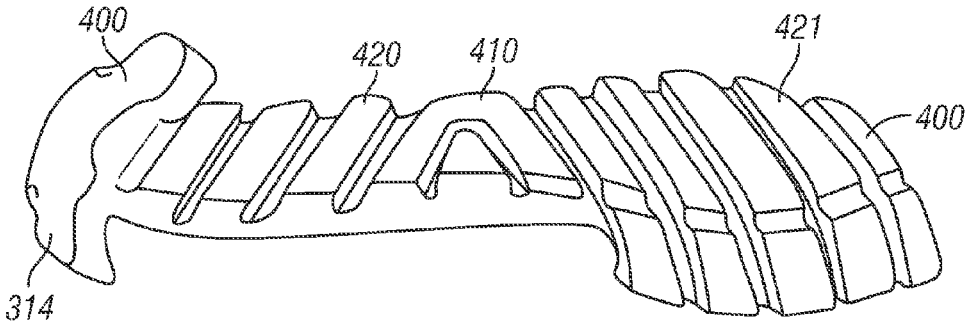
FIG. 18 is a bottom view of an inner midsole of the sole of FIG. 16 according to an embodiment of the present invention.

In one embodiment, outer midsole 300 may include a toe pod 312 disposed at the forward end of the forefoot region 36 of the sole and/or a heel pod 314 disposed at the rear end of the heel region 32. The toe pod 312 may include a generally curved front edge 313 that may conform to the contour of the front or toe of the sole 30. Similarly, the heel pod 314 may include a generally curved rear edge 315 that may conform to the contour of the rear or heel of the sole 30. During the gait cycle, the heel pod 314 may provide cushioning to the wearer during a heel strike event with the ground, and the toe pod 312 may provide cushioning during a toe-off event. In one embodiment, a plurality of outer protrusions 320 may be disposed between the heel pod 314 and the toe pod 312 on the medial 31 and/or lateral side 33 of the sole 30. As shown in FIG. 14, in one embodiment the heel pod 314 may be integrally formed with one or more protrusions 320. In one embodiment, as shown in FIGS. 16 and 18, the heel pod 314 may be formed as part of the inner midsole 400.

The inner midsole 400 includes a centrally disposed midfoot pod 410, a plurality of heel bars 420 that extend generally across a portion of the width of the sole 30 in the heel region 32, and a plurality of forefoot bars 421 that extend generally across a portion of the width of the sole 30 in the forefoot region 36. In one embodiment, the inner midsole 400 extends from the base 310 of the outer midsole 300. In this manner, the outer midsole 300 may be disposed above the inner midsole 400 and may also be referred to as the upper midsole and the inner midsole 400 may also be referred to as the lower midsole. The inner midsole 400 may thus be bottom loaded. In another embodiment, a portion of the inner midsole 400 may be disposed above the base 310, and a portion of the inner midsole, for example, one or more heel bars 420 and/or forefoot bars 421 may extend below the base 310. For example, one or more heel bars 420 and/or forefoot bars 421 may extend through voids formed in the base 310. In this manner, the inner midsole may be top loaded in some embodiments.

The heel bars 420 and forefoot bars 421 may be substantially parallel to each other, and may be connected by connecting members 412 that extend longitudinally along the length of the sole 30. The connecting members 412 may be disposed in the center portion of the sole 30, and may connect protrusions 420 and 421 generally at a center portion. In other embodiments, one or more connecting members 412 may connect other portions (e.g., an end portion) of a protrusion. In one embodiment, the inner midsole 400 may comprise three heel bars 420 and three forefoot bars 421; however, any suitable combination of heel and forefoot bars to provide the desired cushioning and stability may be used. For example, in one embodiment, the inner midsole 400 may comprise two heel bars 420 and four forefoot bars 421.

In one embodiment, the heel bars 420 and forefoot bars 421 are generally rectangular in shape. The heel bars 420 and forefoot bars 421 may have four sides and may have a generally rectangular or quadrilateral cross-section, as shown in FIG. 14. As such, the bottom surface 423 of a heel bar 420 and/or a forefoot bar 421 may be generally rectangular or quadrilateral in shape. In one embodiment, one or more heel bars 420 and forefoot bars 421 may have curved sides such that the bars are wavy in shape, as shown, for example, in FIG. 14. In alternative embodiments, the heel bars 420 and forefoot bars 421 may include substantially straight sides. In some embodiments, a heel bar 420 may have a different shape than another heel bar and/or another forefoot bar 421, and vice versa. The heel bars 420 and/or forefoot bars 421 may also be differently sized. For example, as shown in FIG. 13, the forefoot bars 421 may be longer than heel bars 420. In other embodiments, one or more heel bars 420 and/or a forefoot bars 421 may be longer or wider at a portion of the sole 30 to provide desired cushioning, ride characteristics, and/or stability.

As shown in FIG. 14, the midfoot pod 410 may be disposed between the forward most heel bar 420 and the rear most forefoot bar 421. In one embodiment, the midfoot pod 410 may widen from its lateral side 411 to its medial side 413 so as to be generally triangular in shape. The medial side 413 of the midfoot pod 410 may be forked. In other embodiments, the midfoot pod 410 may be wider on the lateral side 411. Other shapes for the midfoot pod 410 suitable for providing the desired cushioning, ride, and/or stability, including, but not limited to, a generally quadrilateral shape may be used.

One or more adjacent heel bars 420 and/or forefoot bars 421 may be spaced apart by gaps 422. In one embodiment, the gaps 422 are each of the same size such that the heel bars 420 and/or forefoot bars 421 are evenly spaced. In alternative embodiments, the width of some or all of the gaps 422 may be different. For example, in embodiments in which one or more heel bars 420 and/or forefoot bars 421 may be wider at a portion of the sole 30 to provide desired cushioning and stability, gaps 422 may correspondingly be narrower. In one embodiment, gaps 422 may generally have the same width as an adjacent heel bar 420 and/or forefoot bar 421. In other embodiments, gaps 422 may be wider or narrower than the bars. In embodiments where the inner midsole 400 is top loaded and one or more heel bars 420 and/or forefoot bars 421 extend through the base 310, portions of the base 310 may be disposed in the gaps 422.

As discussed above, heel bars 420 and/or forefoot bars 421 extend across all or a portion of the width of the sole 30. In one embodiment, as shown, for example in FIG. 14, a heel bar 420 and a forefoot bar 421 may not extend the entire width between two outer protrusions 320. As such, a space 326 may be provided between ends of the heel bar 420 or the forefoot bar 421 and the adjacent protrusion. The space 326 may allow movement of the outer midsole 300 rim portion or protrusions 320 relative to the inner midsole 400, which may provide for the desired cushioning and feel of the sole 30 to the user during a gait cycle. For example, the space 326 may allow an outer protrusion 320 at the location of the space to splay in multiple directions—outwardly from and inwardly toward the sole—when under a compressive load during use, and thereby allow for a tailored cushioning effect (e.g., allow for increased cushioning) or provide better overall ride of the footwear. In one embodiment, the space 326 may be disposed along all or a portion of the length of the sole on one or both of the medial side 31 and the lateral side 33 depending on the desired characteristics. In one embodiment, the width of the space 326 may vary along the sidewall for desired characteristics. For example, along the medial side 31 of the sole where less movement of the outer midsole 300 relative to the inner midsole 400 may be desired to provide increased stability, the width of the space may be narrower than at other locations of the sole 30.

Figure 19:
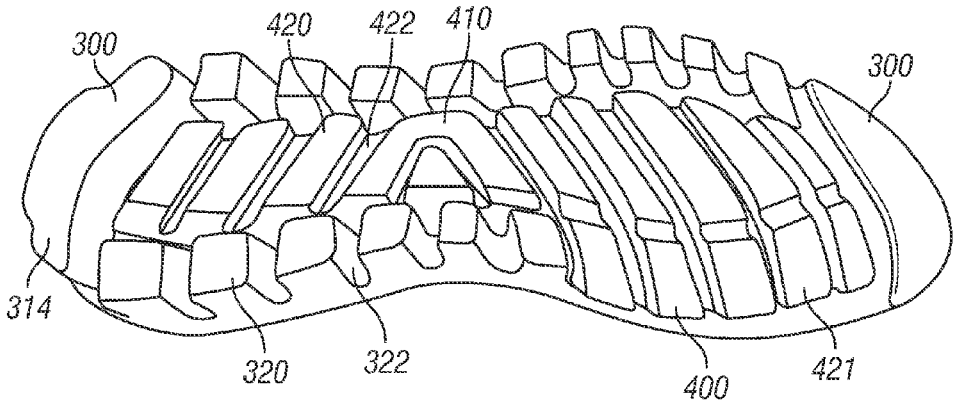
FIG. 19 is a bottom view of a sole according to an embodiment of the present invention.
Figure 20:
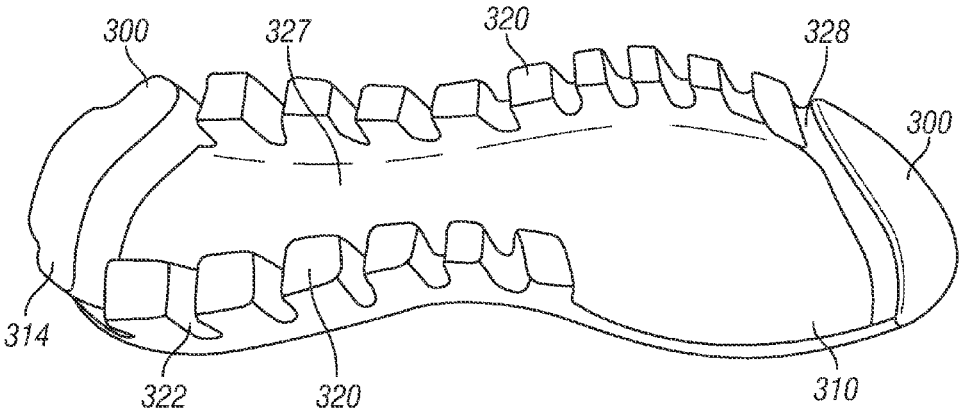
FIG. 20 is a bottom view of an outer midsole of the sole of FIG. 19 according to an embodiment of the present invention.
Figure 21:
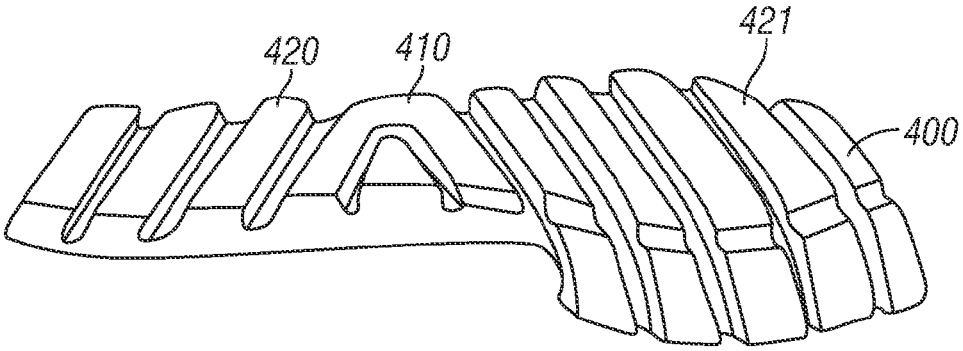
FIG. 21 is a bottom view of an inner midsole of the sole of FIG. 19 according to an embodiment of the present invention.

In other embodiments, the heel bar 420 and/or the forefoot bar 421 may extend the entire width between two outer protrusions 320. As such, no space may be provided between ends of the heel bar 420 or the forefoot bar 421 and the adjacent protrusion, and the heel bar or forefoot bar may be contacting or attached to the protrusion. In one embodiment, one or more heel bars 420 and/or forefoot bars 421 may extend to the outer edge 35 of the base 310, thereby eliminating outer protrusion(s) 420 along the periphery of the base at that location. For example, as shown in FIGS. 16 and 19, the forefoot bars 421 may extend to the outer edge 35 of the base on the medial side 31 of the sole. In this embodiment, the sole 30 may be without any outer protrusions 320 on the medial side in the forefoot region; however, the forefoot bars 421 may provide the desired cushioning and stability in the area.

In one embodiment, with reference to FIGS. 13 and 15, portions of the outer midsole 300 and the inner midsole 400 may be angled to provide the desired cushioning and/or stability of the sole 30. In one embodiment, the outer protrusions 320 may be angled toward the rear of the footwear 10 from the base 310 to the bottom surface 321. In one embodiment, the heel bars 420 and the forefoot bars 421 may be angled toward the front of the footwear 10. In alternative embodiments, one or more of the outer protrusions 320, the heel bars 420 and the forefoot bars 421 may be straight while others are angled. As best shown in FIG. 15, in one embodiment, a portion of the inner midsole 400 may be visible through a gap 322. In embodiments in which both elements of the inner midsole 400 and the outer midsole 300 are angled, the visibility of the inner midsole 300 may create a cross-hatched or latticed appearance of the side of the sole 30.

The inner midsole 400 and the outer midsole 300 comprise material for providing the desired cushioning, ride, and stability of the sole 30. Suitable material for the inner midsole 400 and the outer midsole 300 may include, but is not limited to, foam and thermoplastic polyurethane. When the inner midsole 400 and/or the outer midsole 300 are a foam, the foam may comprise, for example, ethyl vinyl acetate (EVA) based foam or polyurethane (PU) based foam and the foam may be an open-cell foam or a closed-cell foam. In other embodiments, the inner midsole 400 and/or the outer midsole 300 may comprise elastomers, thermoplastic elastomers (TPE), foam-like plastic, and gel-like plastics. Suitable materials for inner midsole 400 and/or outer midsole 300 may be obtained from, for example, Eclipse Polymers Co., Sung Shin Co., and Korea Fine Chemical Co.

In one embodiment, the inner midsole 400 and the outer midsole 300 may comprise different materials. In one embodiment, the inner midsole 400 and the outer midsole 300 may have different hardness characteristics. For example, in one embodiment it may be desirable for the sole 30 to be stiffer near the periphery of the sole to provide required lateral and/or medial stability. In this manner, outer midsole 300 including one or more outer protrusions 320 may comprise a harder material than inner midsole 400.

In some embodiments, the material hardness of the outer midsole 300 (e.g., the base 310 and/or the protrusions 320) may range from about 50 Asker C to about 70 Shore D, for example, about 60C to about 75C or about 65C to about 70C. In some embodiments, the material hardness of the inner midsole 400 may range from about 20C to about 70C, for example, about 40C to about 60C or about 50C to about 55C. In some embodiments, the material hardness of the outer midsole 300 may range from about 50 Asker C to about 70 Shore D and the material hardness of the inner midsole 400 may range from about 20C to about 70C, for example, the material hardness of the outer midsole 300 may range from about 60C to about 75C and the material hardness of the inner midsole 400 may range from about 40C to about 60C.

In some embodiments, the material density of the outer midsole 300 may be about 0.3 to about 0.5 grams/cubic centimeter ($g/cm^3$), for example, such as about 0.35 to about 0.4 $g/cm^3$. In some embodiments, the material density of the inner midsole 400 may be about 0.25 to about 0.5 $g/cm^3$, for example, such as about 0.25 to about 0.3 $g/cm^3$. In some embodiments, the material density of the outer midsole 300 is higher than the material density of the inner midsole 400. For example, in one embodiment, the material density of the outer midsole 300 is about 0.35 to about 0.4 $g/cm^3$ and the material density of the inner midsole 400 is about 0.25 to about 0.3 $g/cm^3$. In other embodiments, the material density of the outer midsole 300 is lower than, or even equal to, the material density of the inner midsole 400.

In some embodiments, the outer midsole 300 material has a higher modulus than that of the inner midsole 400 material. In other embodiments, the outer midsole 300 material has a modulus that is lower, or even equal to, that of the inner midsole 300 material.

The inner midsole 400 and the outer midsole 300 may be formed using suitable techniques, including, but not limited to, injection molding, blow molding, compression molding, and rotational molding. The inner midsole 400 and the outer midsole 300 may be formed separately and attached. In one embodiment, the inner midsole 400 may be attached to the base 310 by adhesive bonding, welding or other suitable attachment techniques. In some embodiments, as shown, for example, in FIGS. 17 and 20, a cavity 327 may be formed in the base 310 for receiving the inner midsole 400. One or more indentions 328 formed in the base 310 may further facilitate attachment or securing of the inner midsole 400 to the outsole 300. In another embodiment, the inner midsole 400 and the outer midsole 300 may be monolithic and may be integrally formed as a unitary structure. For example, the inner midsole 400 and the outer midsole 300 may be co-molded and thereby formed together simultaneously.

All or a portion of the outer midsole 300 and/or the inner midsole 400 may contact the ground during a gait cycle. The bottom surface 321 of the outer protrusions 320 and may be substantially flat, or may be slightly rounded or crowned. Similarly, the bottom surface 423 of the inner midsole 400, including the heel bars 420, the forefoot bars 421, and the midfoot pod 410, may be substantially flat, or may be slightly rounded or crowned. In one embodiment, the sole 30 may include an outsole 330 disposed on the outer midsole 300 and/or the inner midsole 400 to provide increased traction and durability to the sole 30. For example, as shown in FIG. 14, outsole 330 may be disposed on the toe pod 312 and the heel pod 314. In some embodiments, outsole 330 may be disposed on all or some of the bottom surface 321 of the outer protrusions 320, and/or all or some of the bottom surface 423 of the heel bars 420 and/or the forefoot bars 421. The outsole 130 may comprise a rubber compound, such as, for example, Shin Ho KA2BF high abrasion rubber compound, or other suitable material. The outsole 330 may be formed separately from the inner midsole 400 and/or the outer midsole 300 and attached, or formed integrally to form a unitary structure.

As discussed herein, in embodiments of the present invention the geometry, interrelation, and material properties of the outer midsole 100 and inner midsole 200, and the outer midsole 300 and inner midsole 400 may be varied to provide the desired characteristics of the sole. For example, when harder or denser materials are used, generally, one or a combination of more gaps, larger gaps, smaller cross-section undulating portions (e.g., peaks and/or troughs) or protrusions, fewer undulating portions (e.g., peaks and/or troughs) or protrusions, and larger splay angles may be needed to obtain similar cushioning, stability, and/or ride characteristics. When softer or less dense materials are used, generally, one or a combination of fewer gaps, smaller gaps, larger cross-section undulating portions (e.g., peaks and/or troughs) or protrusions, more undulating portions (e.g., peaks and/or troughs) or protrusions, and smaller splay angles may be needed to obtain similar cushioning, stability, and/or ride characteristics.

The article of footwear 10 for various embodiments described herein may comprise an athletic shoe suited for a particular activity, such as, for example, a walking shoe, a running shoe, a basketball shoe, a court shoe, a tennis shoe, a training shoe, a boot, and the like. It is contemplated that the article of footwear may not include an upper 20. For example, in one embodiment, the sole 30 may be used in conjunction with a sandal or other footwear not including an upper.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. For example, embodiments of the outer midsole 100 may be used in conjunction with the inner midsole 400, and embodiments of the inner midsole 200 may be used in conjunction with the outer midsole 300. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, the sole comprising:
an outer midsole comprising:
a row of medial outer protrusions;
a row of lateral outer protrusions;
a base contiguous with the medial outer protrusions and the lateral outer protrusions,
wherein the medial outer protrusions protrude downward from the base along a medial edge of the outer midsole,
wherein the lateral outer protrusions protrude downward from the base along a lateral edge of the outer midsole, and
wherein the medial outer protrusions, lateral outer protrusions, and base together define a space of the outer midsole; and
an inner midsole disposed within the space of the outer midsole, the inner midsole comprising an upward-facing surface coupled to a downward-facing surface of the base between the row of medial outer protrusions and the row of lateral outer protrusions,
wherein the base connects the medial outer protrusions and the lateral outer protrusions transversely across the sole above the inner midsole,
wherein the medial outer protrusions and the lateral outer protrusions define a portion of a ground-contacting surface of the sole, and
wherein the outer midsole is an integrally formed unitary structure.

2. The sole of claim 1, wherein the inner midsole defines a portion of a ground-contacting surface of the sole.

3. The sole of claim 1, wherein the inner midsole is coupled to the medial or lateral protrusions of the outer midsole.

4. The sole of claim 1, wherein the inner midsole comprises a bar extending between a medial protrusion of the outer midsole and a lateral protrusion of the outer midsole.

5. The sole of claim 1, wherein the outer midsole and the inner midsole define outermost bottom surfaces of the sole.

6. The sole of claim 1, wherein the inner midsole further comprises a protrusion protruding downward from a toe end of the inner midsole and extending from a medial side and a lateral side of the sole.

7. The sole of claim 1, wherein the inner midsole further comprises a protrusion protruding downward from a heel end of the inner midsole and extending from a medial side and a lateral side of the sole.

8. The sole of claim 1, wherein the outer midsole further comprises a protrusion protruding downward from a toe end of the outer midsole and extending from the medial side to the lateral side of the outer midsole.

9. The sole of claim 1, wherein the outer midsole further comprises a protrusion protruding downward from a heel end of the outer midsole and extending from the medial side to the lateral side of the outer midsole.

10. The sole of claim 1, wherein the inner midsole and the outer midsole are composed of different materials.

11. The sole of claim 10, wherein the different materials have different densities.

12. A sole for an article of footwear, the sole comprising:

an outer midsole comprising a plurality of outer protrusions extending downward from a medial side and a lateral side of the outer midsole; and an inner midsole comprising a plurality of transverse bars, wherein the inner midsole comprises an upward-facing surface fixed to a downward-facing surface of the outer midsole between outer protrusions extending from the medial side of the outer midsole and outer protrusions extending from the lateral side of the outer midsole, wherein each transverse bar is disposed medially adjacent to and extends from a lateral outer protrusion to the medial side of the outer midsole.

13. The sole of claim 12, wherein at least one of the transverse bars defines a portion of an outermost side surface of the outer midsole.

14. The sole of claim 12, wherein at least one of the transverse bars extends to a medial outer protrusion.

15. A sole for an article of footwear, the sole comprising:

a base having an outer edge having a plurality of outer protrusions extending from the outer edge, and an inner midsole having a plurality of transverse bars that extend transversely across the base, wherein at least one of the transverse bars extends to the outer edge of the base and wherein at least one of the transverse bars does not extend to the outer edge of the base, wherein an outermost edge of the sole is defined at least in part by the plurality of outer protrusions and at least one of the plurality of transverse bars formed on the inner midsole.

16. The sole of claim 15, wherein at least one of the transverse bars extends to the medial side of the base.

17. The sole of claim 15, wherein at least one of the transverse bars connects opposing outer protrusions.

18. The sole of claim 15, wherein the plurality of outer protrusions extend inwardly from the outer edge of the base.

19. The sole of claim 15, wherein the plurality of outer protrusions extend outwardly beyond the outer edge of the base.

20. The sole of claim 1, wherein the base comprises no contiguous protrusions between the medial outer row of protrusions and the lateral outer row of protrusions.

21. The sole of claim 15, wherein each of the plurality of transverse bars is disposed transversely adjacent to at least one of the plurality of outer protrusions.

22. The sole of claim 1, wherein the inner midsole and the outer midsole are an integrally formed unitary structure.

* * * * *